US007740517B2

(12) United States Patent
Hochstrasser

(10) Patent No.: US 7,740,517 B2
(45) Date of Patent: Jun. 22, 2010

(54) MULTI-FUNCTION YO-YO

(76) Inventor: Alex Hochstrasser, Seefeldstrasse 178, 8008 Zurich (CH)

( * ) Notice: Subject to any disclaimer, the term of this patent is extended or adjusted under 35 U.S.C. 154(b) by 274 days.

(21) Appl. No.: 12/082,309

(22) Filed: Apr. 10, 2008

(65) Prior Publication Data

US 2009/0258568 A1 Oct. 15, 2009

(51) Int. Cl.
*A63H 1/30* (2006.01)
*A63H 1/00* (2006.01)

(52) U.S. Cl. ..... 446/250

(58) Field of Classification Search ..... 446/247–250, 446/234–236, 259, 262, 263, 281
See application file for complete search history.

(56) References Cited

U.S. PATENT DOCUMENTS 4,332,102 A * 6/1982 Caffrey ..... 446/250
6,053,796 A * 4/2000 Tung ..... 446/250
6,354,905 B1 * 3/2002 Haines et al. ..... 446/250
6,626,932 B2 * 9/2003 Whitehurst ..... 607/88
7,059,932 B1 * 6/2006 Tobias et al. ..... 446/250

* cited by examiner

*Primary Examiner*—Kien T Nguyen
(74) *Attorney, Agent, or Firm*—Integral Patent Associates; Laurence J. Shaw

(57) ABSTRACT

A multi-function yo-yo switchable between operation as a traditional yo-yo, a free-spin yo-yo, and a centrifugal-clutch yo-yo. Within one or both of the fly disks is one or more rotational-speed governors, and about the axle is a cylindrical axle sleeve which is rotatable about the axle. Each governor is spring-biased to an inwards position the governor contacts the axle sleeve, forcing the axle sleeve to rotate with the fly disks and axle. However, when the yo-yo spins sufficiently rapidly, the governors are thrown by centrifugal force to a radially-outwards position so as not to be in contact with the axle sleeve so that the axle sleeve may rotate independently of the fly disks. A function control switch locks the governors in the inwards position or the outwards position or allows the position to be controlled by centrifugal force.

10 Claims, 13 Drawing Sheets

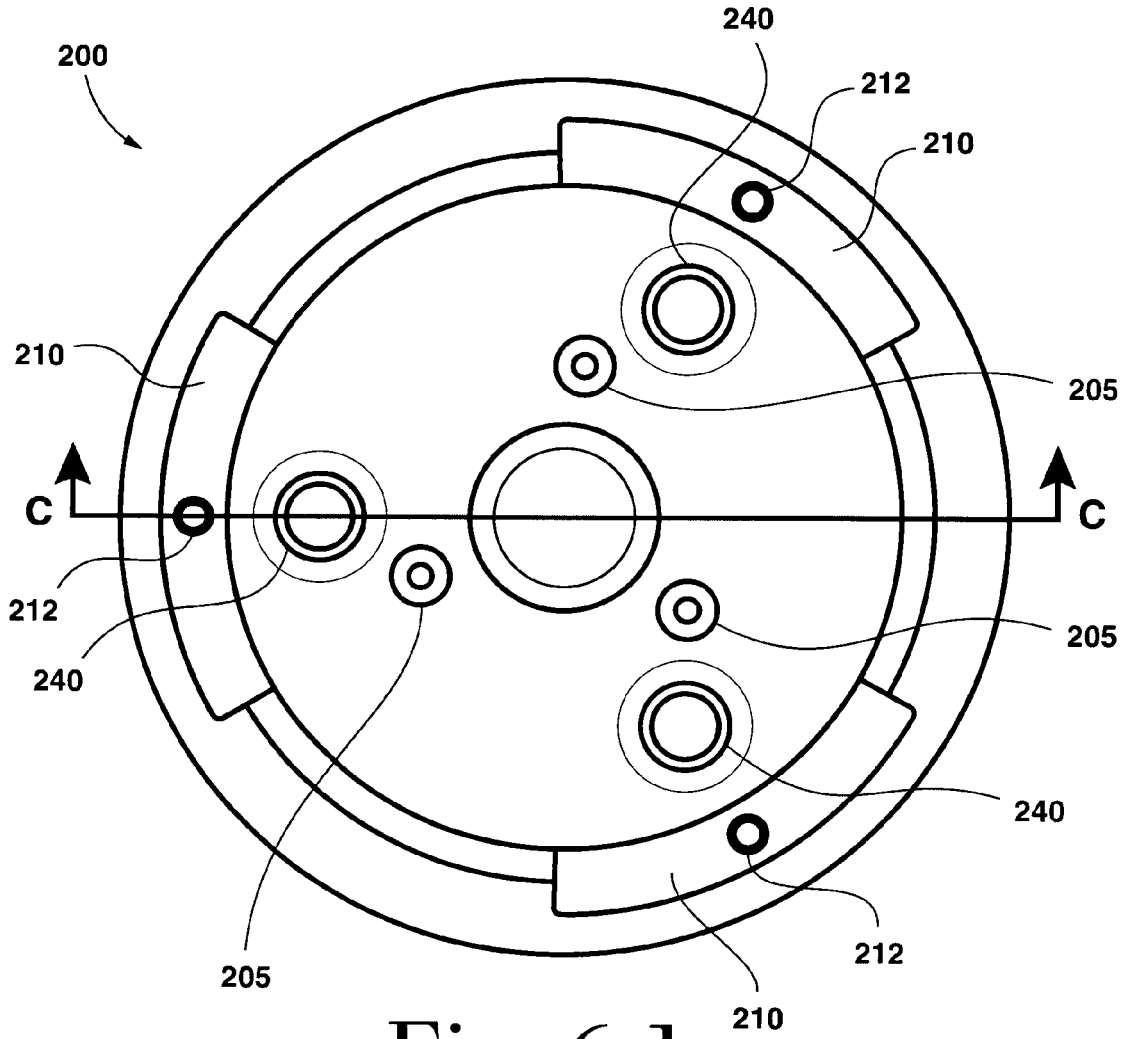
Fig. 6.1
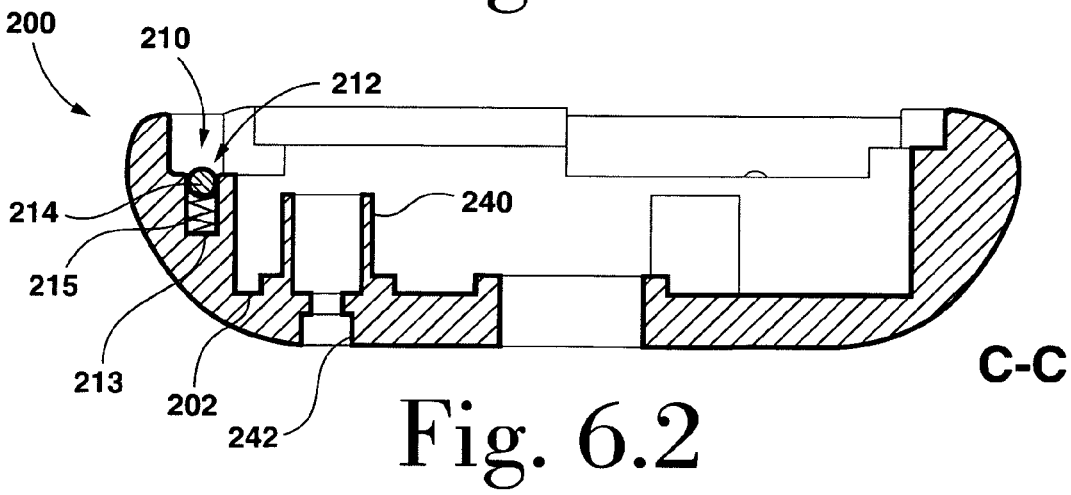
Fig. 6.2

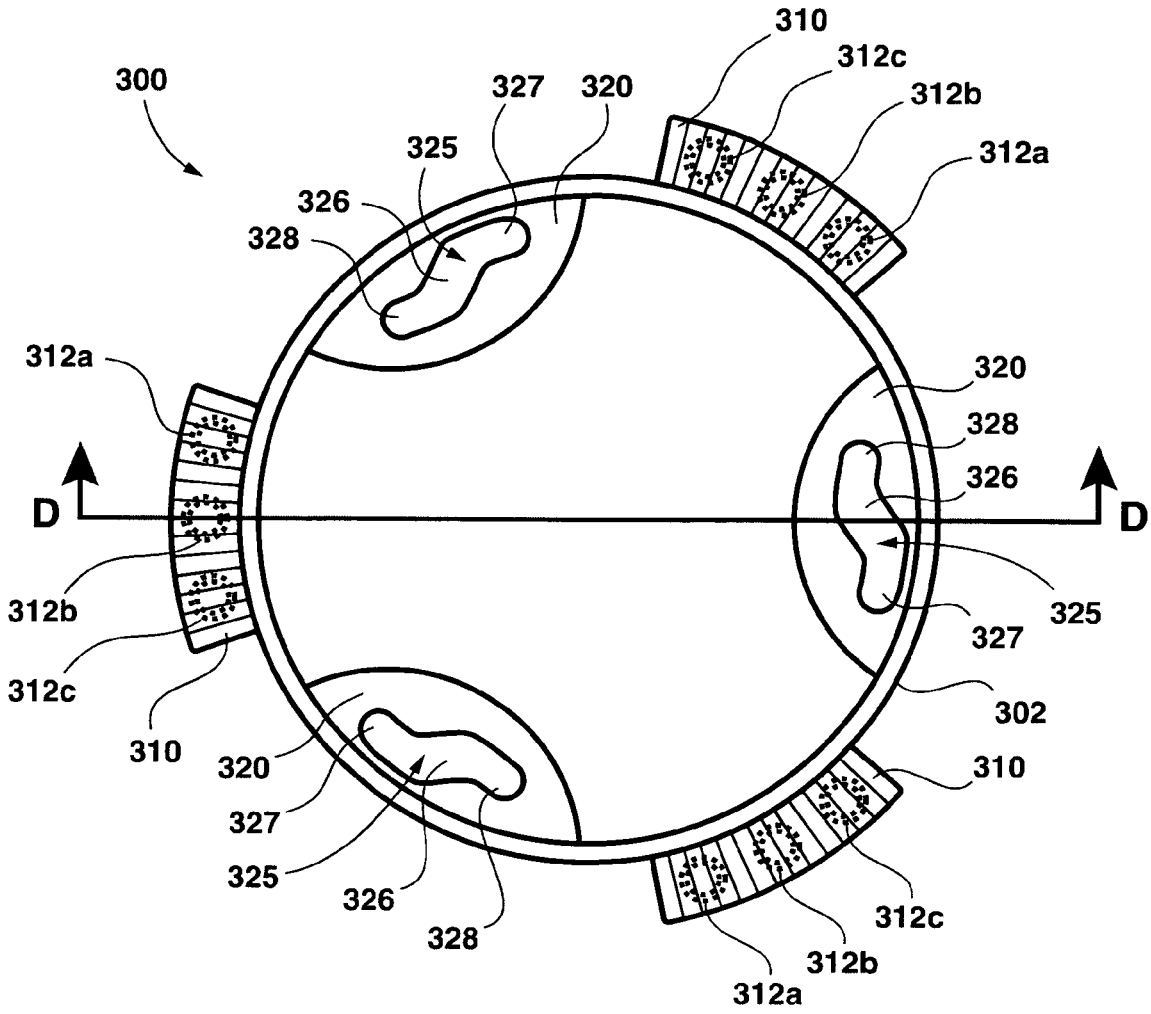
Fig. 7.1
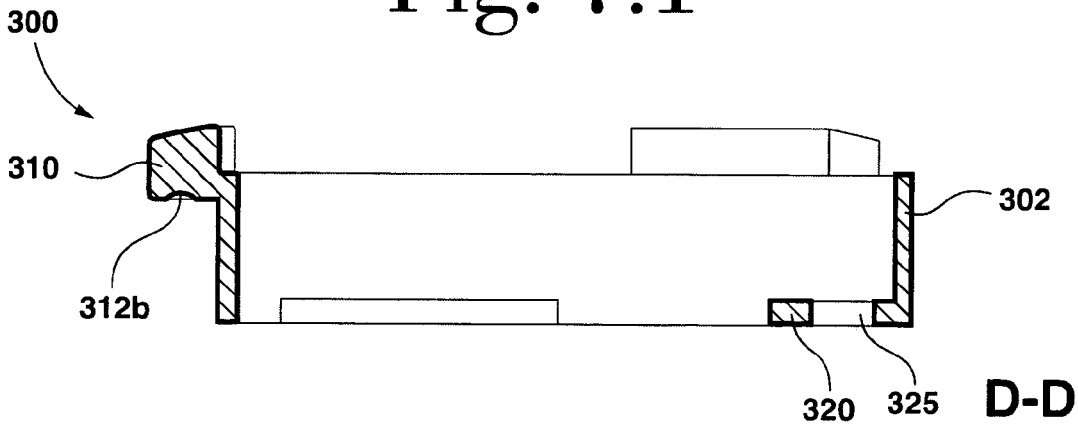
Fig. 7.2

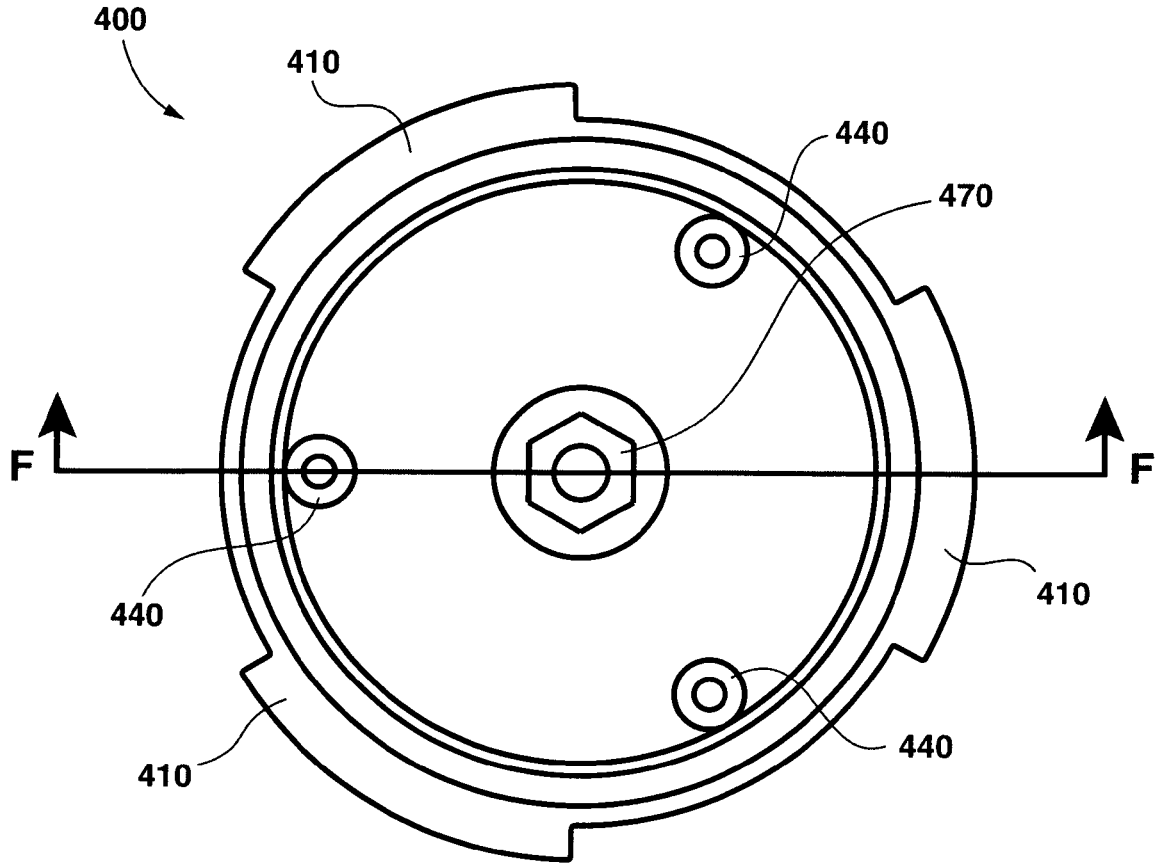
Fig. 8.1
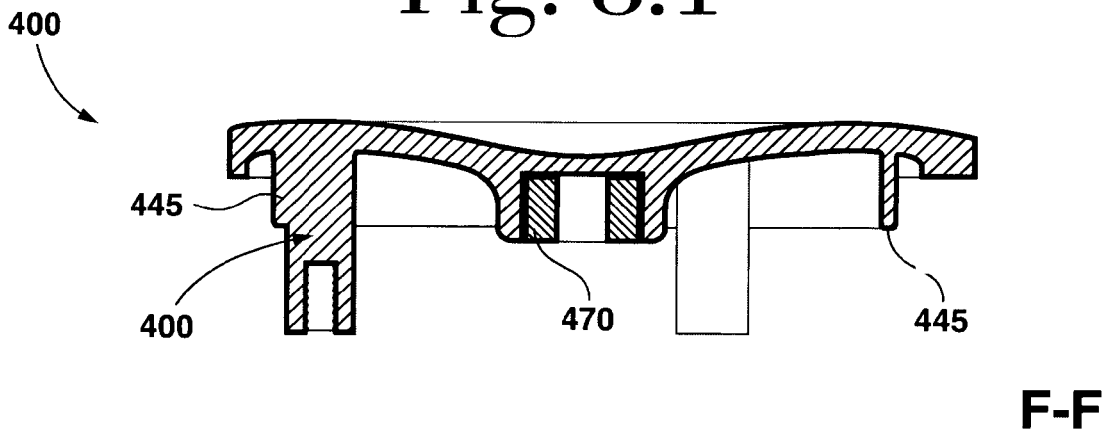
Fig. 8.2

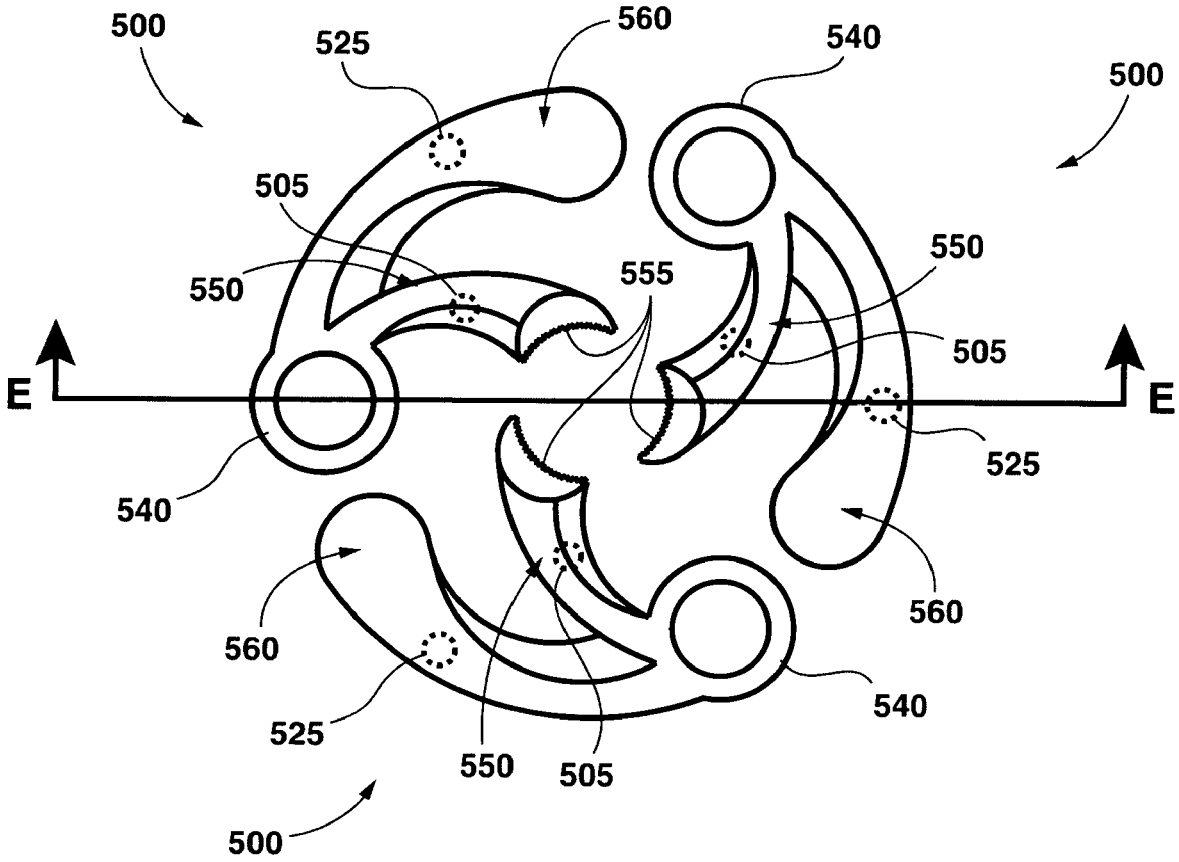
Fig. 9.1
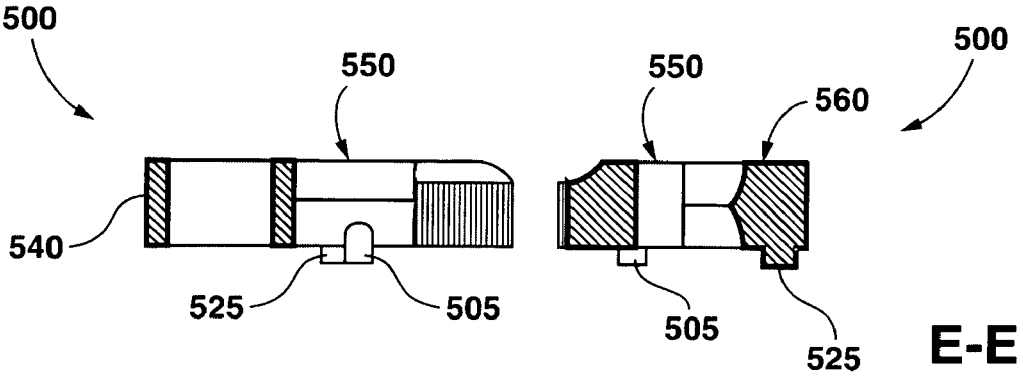
Fig. 9.2

MULTI-FUNCTION YO-YO

RELATED APPLICATIONS

The present non-provisional patent application is based on non-provisional patent application Ser. No. 11/337,423 filed on Jan. 23, 2006 by Alex Hochstrasser entitled "Multi-Function Yo-Yo," which is based on provisional patent application Ser. No. 60/646,448 filed on Jan. 24, 2005 by Alex Hochstrasser entitled "Multi-Function Yo-Yo."

FIELD OF THE INVENTION

The present invention is related to yo-yos.

BACKGROUND OF THE INVENTION

The traditional yo-yo has two closely-spaced fly disks which have their axes of cylindrical symmetry aligned and are joined by a narrow axle along the axis of cylindrical symmetry. The traditional yo-yo includes a string which is attached, i.e., fixed, to the axle. The basic yo-yoing operation of the traditional yo-yo is the unrolling of the string about the axle as the yo-yo moves away from the operator, followed by the rolling up of the string about the axle as the yo-yo returns to the operator.

A free-spin yo-yo has a two-strand twisted string with a single-strand loop at its end so the axle can spin within the loop. A basic yo-yoing operation performable with the free-spin yo-yo is to make it "sleep," i.e., spin at the end of the unrolled string without immediately returning up the string. Controlling if a free-spin yo-yo sleeps or returns, and controlling the length of a sleep requires some skill.

U.S. Pat. No. 4,332,102, issued Jun. 1, 1982 to Michael S. Caffrey, teaches a yo-yo which has a centrifugal force-actuated spring-loaded clutch mechanism. When the yo-yo rotates with sufficient speed, centrifugal force causes clutch members (16) and (18) mounted on the body to move outwards away from contact with a central hub (20) of the axle so the yo-yo operates as a free-spin yo-yo. Therefore, with a sufficiently hard "throw," the yo-yo can be readily made to sleep. However, as the rotation of the yo-yo slows or as the result of a sharp translational acceleration, the clutch members (16) and (18) are spring biased by springs (22) and (24) to grip the central hub (20) so that the yo-yo operates as a traditional yo-yo. Therefore, sleeping is terminated and the yo-yo readily returns along the string by tugging on the string or waiting until the rotation of the yo-yo slows sufficiently. Thus, a centrifugal-clutch yo-yo provides the advantage of being easily induced to sleep like a free-spin yo-yo, and easily induced to return along the string like a traditional yo-yo.

Therefore, it is an object of the present invention to provide a yo-yo having multiple modes of functions.

It is another object of the present invention to provide a yo-yo which can function as a traditional yo-yo or a free-spin yo-yo or a centrifugal-clutch yo-yo.

It is another object of the present invention to provide a multi-function yo-yo which is easily switched between different modes of functioning.

It is another object of the present invention to provide a multi-function yo-yo which has multiple, readily accessible function-switching levers.

Additional objects and advantages of the invention will be set forth in the description which follows, and will be apparent from the description or may be learned from the practice of the invention. The objects and advantages of the invention may be realized and obtained by means of the instrumentalities and combinations particularly pointed out in the claims.

SUMMARY OF THE INVENTION

A multi-function yo-yo having an axle, fly disks mounted at each end of the axle, and a rotatable axle sleeve. Within one of the fly disks is a rotational-speed governor which is spring-biased to an "inwards" position where a grip on the governor contacts the axle sleeve forcing the axle sleeve to rotate with the fly disk. When the governor is in an "outwards" position, the grip on the governor is not in contact with the axle sleeve and the axle sleeve may rotate independently of the axle and fly disks. A function control switch on the exterior of the yo-yo has three positions. When the function control switch is in its first position, the governor is locked in a radially-inwards position and the yo-yo functions as a fixed axle yo-yo. When the function control switch is in the second position, the governor is locked in a radially-outwards position and the yo-yo functions as a free axle yo-yo. When the function control switch is in the third position, the governor is thrown to the radially-outwards position when the yo-yo spins fast enough and the spring-biasing is overcome by centrifugal force, and is drawn to the radially-inwards position when the yo-yo spins slow enough and the spring-biasing force overcomes centrifugal force. With the switch in the third position, the yo-yo functions as a centrifugal-clutch yo-yo, i.e., as a free-spin yo-yo when it is spinning sufficiently rapidly, and as a traditional yo-yo when it is spinning sufficiently slowly.

BRIEF DESCRIPTION OF THE FIGURES

The accompanying figures, which are incorporated in and form a part of this specification, illustrate embodiments of the invention and, together with the description given above and the detailed description of the preferred embodiments given below, serve to explain the principles of the present invention.

FIG. 6.1 is a plan view of the base of the mechanism of the yo-yo of the present invention.

FIG. 6.2 is a cross-sectional side view of the base shown in FIG. 6.1.

FIG. 7.1 is a plan view of the switch chassis of the mechanism of the yo-yo of the present invention.

FIG. 7.2 is a cross-sectional side view of the switch chassis shown in FIG. 7.1.

FIG. 8.1 is a plan view of the cover of the mechanism of the yo-yo of the present invention.

FIG. 8.2 is a cross-sectional side view of the cover shown in FIG. 8.1.

FIG. 9.1 is a plan view of the governors of the mechanism of the yo-yo of the present invention.

FIG. 9.2 is a cross-sectional side view of the governors shown in FIG. 9.1.

DETAILED DESCRIPTION OF THE PREFERRED EMBODIMENT

Overview

The present invention is a yo-yo with a mechanism for switching between three modes of functioning: as a traditional yo-yo, as a free-spin yo-yo, and as a centrifugal-clutch yo-yo. The convenience and ease with which the setting may be switched by a player even allows the mode of functioning to be switched between closely time-spaced throws, allowing the player to perform tricks requiring different operational characteristics in rapid sequence.

Figure 1A:
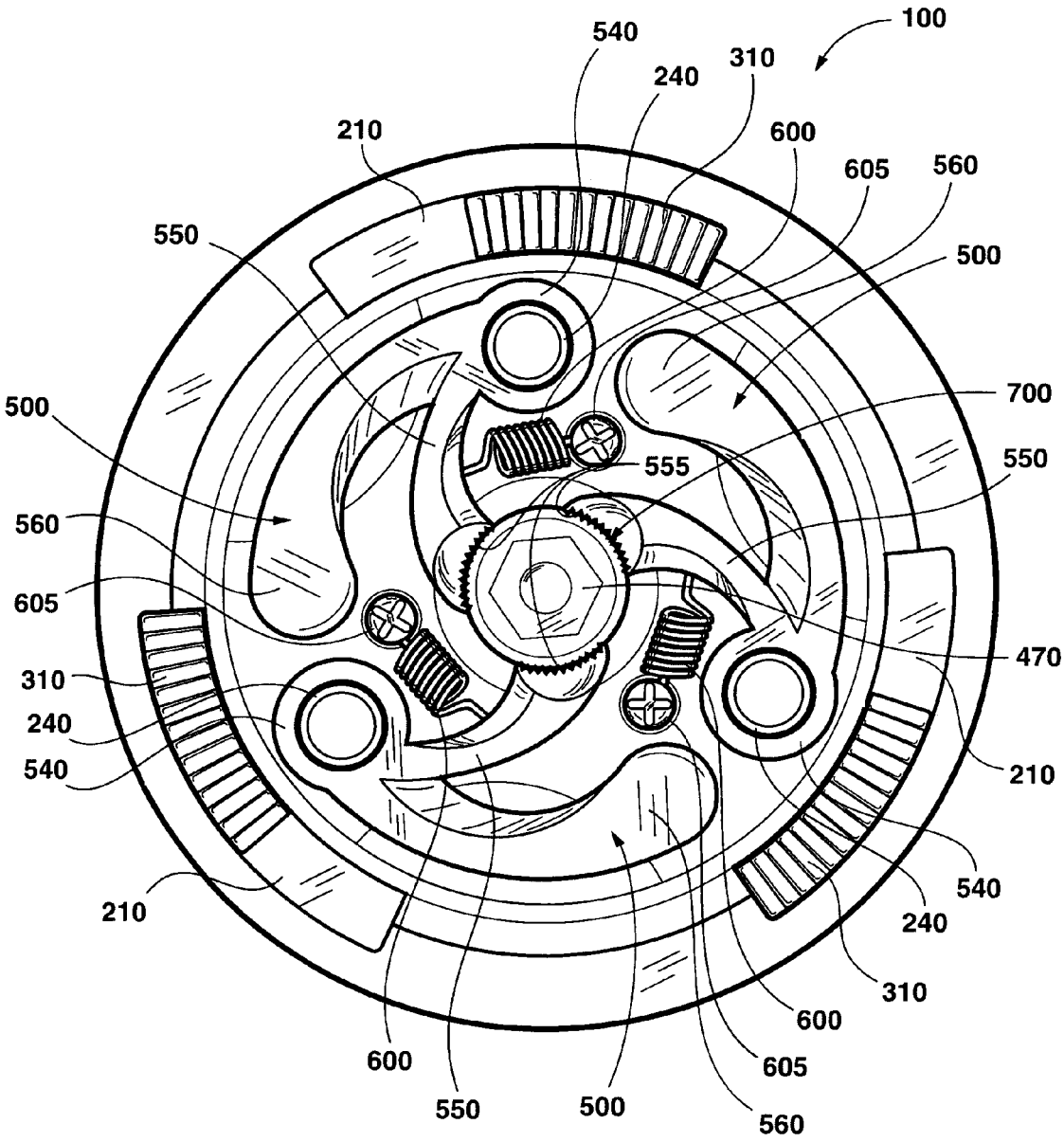
FIG. 1A is a plan view of the mechanism of the yo-yo of the present invention in a setting providing a traditional yo-yo.

FIG. 1A shows the mechanism of the yo-yo (100) of the present invention in a first setting, the "locked" setting, where the switch levers (310) are in the far-clockwise position. In the locked setting, the grip pads (555) of the inner arms (550) of the governors (500) grip the portion of the axle (700) in contact with the string (900), forcing the portion of the axle (700) in contact with the string (900) to rotate with the body of the yo-yo (100), so that the axle (700) spins with the body of the yo-yo (100) and the yo-yo (100) operates as a traditional yo-yo.

Figure 2A:
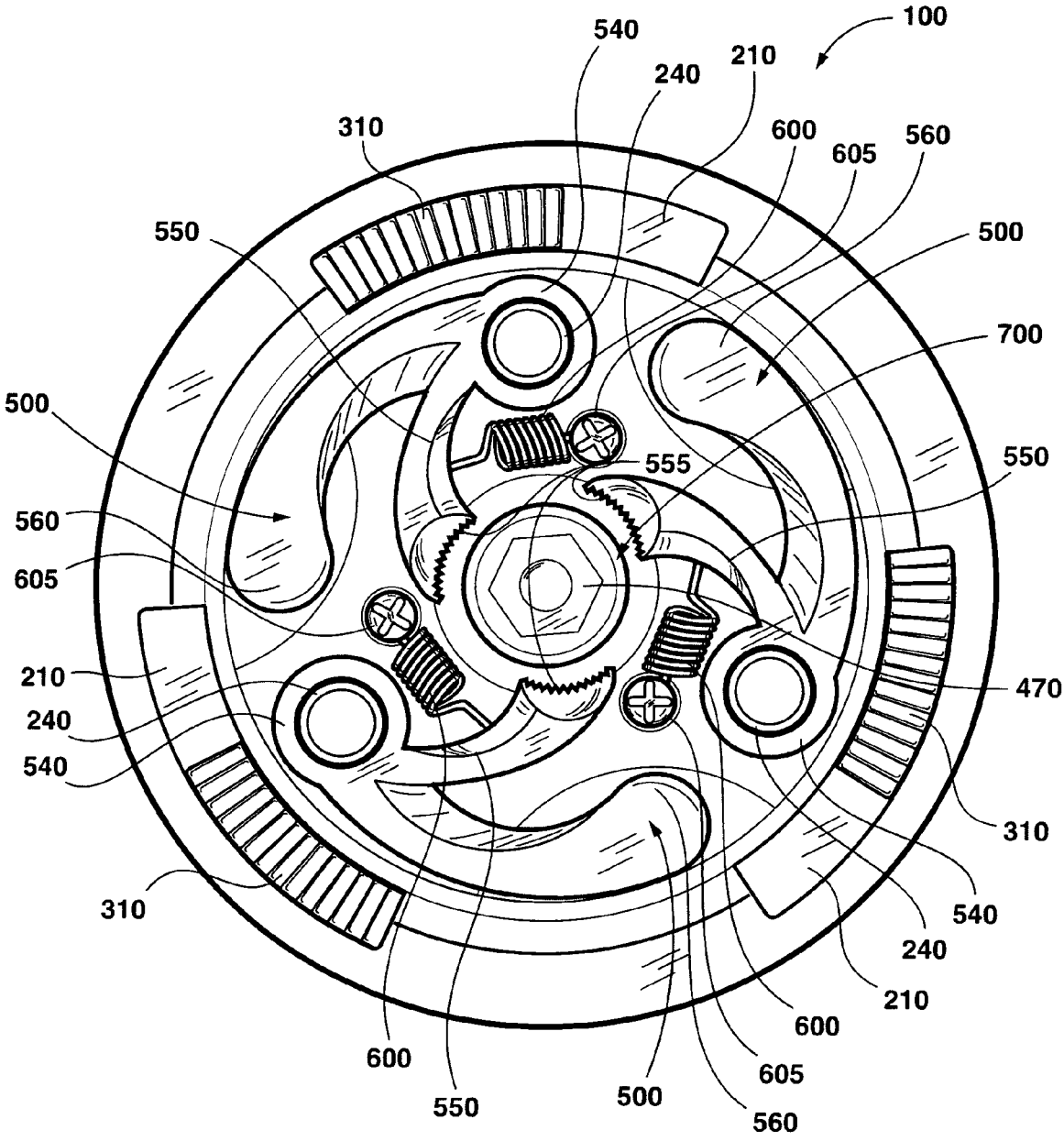
FIG. 2A is a plan view of the mechanism of the yo-yo of the present invention in the setting providing a free-spin yo-yo.

FIG. 2A shows the mechanism of the yo-yo (100) of the present invention in a second setting, the "open" setting, where the switch levers (310) are in the far-counterclockwise position. In the open setting, the grip pads (555) of the inner arms (550) of the governors (500) are not in contact with the portion of the axle (700) in contact with the string (900), so that the portion of the axle (700) in contact with the string (900) is freely rotatable relative to the body of the yo-yo (100) and the yo-yo (100) operates as a free-spin yo-yo.

Figure 3A:
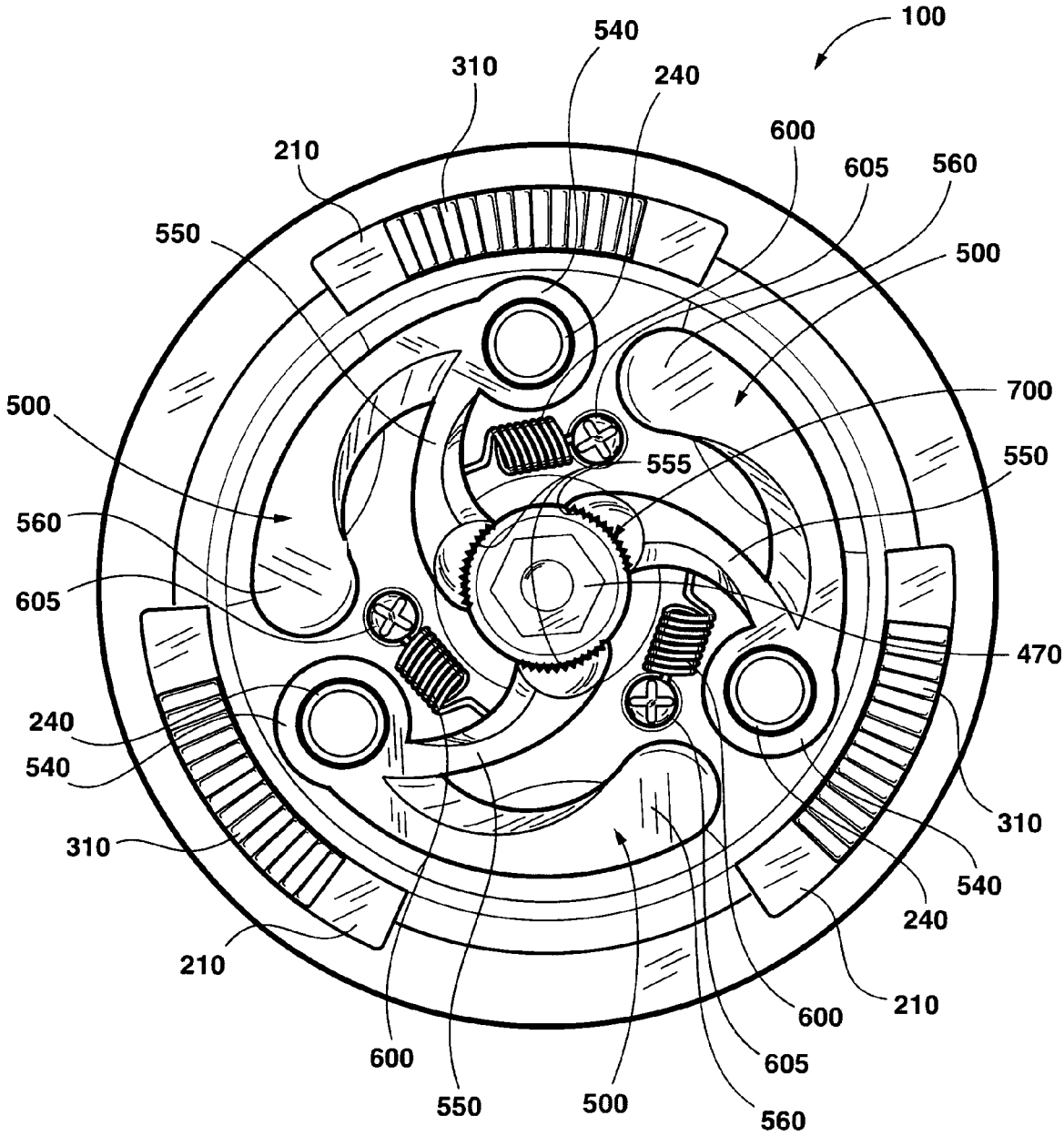
FIG. 3A is a plan view of the mechanism of the yo-yo of the present invention in the setting providing a centrifugal-clutch yo-yo with no centrifugal force acting on the governors.

FIG. 3A shows the mechanism of the yo-yo (100) of the present invention in a third setting, the "centrifugal-clutch" setting, where the switch levers (310) are in the central position. In the centrifugal-clutch setting, the grip pads (555) of the inner arms (550) of the governors (500) move away from contact with the portion of the axle (700) in contact with the string (900) due to centrifugal force when the body spins rapidly, so that the portion of the axle (700) in contact with the string (900) is freely rotatable relative to the body of the yo-yo (100) and the yo-yo (100) operates as a free-spin yo-yo. But when the body of the yo-yo (100) spins more slowly, the biases produced by the springs (600) overcome the centrifugal force on the governors (500) to bring the grip pads (555) of the inner arms (550) of the governors (500) into contact with the portion of the axle (700) in contact with the string (900), so that the portion of the axle (700) in contact with the string (900) spins with the body of the yo-yo (100) and the yo-yo (100) operates as a traditional yo-yo. Also, when there is a sharp translational acceleration perpendicular to the spin axis of the yo-yo (100) (i.e., perpendicular to the longitudinal axis of the axle (700)), for instance as a result of a tug on the yo-yo string, the governors (500) may be forced inwards so that the grip pads (555) of the governors (500) grip the portion of the axle (700) in contact with the string (900) and the yo-yo (100) operates as a traditional yo-yo.

DETAILED DESCRIPTION OF THE MECHANISM

The mechanism of the present invention, and how the three settings produce the above-described modes of functioning, is now described in detail with reference to the x-ray plan views of FIGS. 1B, 2B, 3B and 4B, the cross-sectional side view of FIG. 5, and the plan views and cross-sectional side views of the base, switch, cover and governors of FIGS. 6.1 and 6.2, 7.1 and 7.2, 8.1 and 8.2, and 9.1 and 9.2, respectively, as well as plan views, FIGS. 1A, 2A, 3A and 4A, discussed above. The cross-sectional side views of FIGS. 6.2, 7.2, 8.2 and 9.2 are views across cut-lines C-C, D-D, F-F and E-E of the plan views of the base (200), switch chassis (300), cover (400) and governors (500) of FIGS. 6.1, 7.1, 8.1 and 9.1, respectively As can be seen from the figures, the mechanism of the preferred embodiment has rotational three-fold symmetry, so there are three of each component of the base (200), switch (300) and cover (400), as well as three governors (500), three springs (600), etc. The three-fold symmetry provides various advantages in functionality and operation. It should be noted that, as shown in FIG. 5, one side (100A) of the yo-yo (100) of the present invention is a fly disk which holds the mechanism, and that is the side (100A) discussed in detail below. (In FIG. 5 the string (900) is not shown in cross-section.) The other side (100B) of the yo-yo is a fly disk which does not contain moving parts (with the exception of the axle bushing (770), to the extent that it extends into that side (100B) of the yo-yo (100)), but has substantially the same weight, outer dimensions, and moment of inertia about the spin axis as the side (100A) with the mechanism.

For ease of description, the present specification will sometime use the directional adjectives up, down, top, bottom, etc., and in such cases the adjectives are used with respect to the side view orientations of the parts shown in FIGS. 5, 6.2, 7.2, 8.2 and 9.2. Similarly, the directional adjectives clockwise and counterclockwise are used with respect to the plan view orientations of the parts shown in FIGS. 1A, 1B, 2A, 2B, 3A, 3B, 4A, 4B, 5, 6.1, 7.1, 8.1 and 9.1. Furthermore, the axial direction is the direction parallel to the longitudinal axis of the axle (700), i.e., perpendicular to the plane of the paper in FIGS. 1A, 1B, 2A, 2B, 3A, 3B, 4A, 4B, 6.1, 7.1, 8.1 and 9.1. For a point off the longitudinal axis of the axle (700), the radial direction is perpendicular to the axial direction and through the point, i.e., emanating outwards from the center of the axle (700) in the plane of the paper in FIGS. 1A, 1B, 2A, 2B, 3A, 3B, 4A, 4B, 6.1, 7.1, 8.1 and 9.1. For a point off the longitudinal axis of the axle (700), the azimuthal direction is perpendicular to the axial and radial directions and through the point, i.e., for a point away from the longitudinal axis of the axle (700), the azimuthal direction is through the point and perpendicular to the plane of the paper in FIGS. 5, 6.2 and 9.2. It should be noted that according to the lexography of the present specification, items are said to be cylindrically symmetric, substantially cylindrically symmetric, or to have an axis of substantial cylindrical symmetry or the like, when they function in terms of rotational dynamics, alone or in conjunction with adjoining items, equivalently to an item of cylindrical symmetry when rotated about the axis of cylindrical symmetry. Similarly, items are said to be parallel, substantially parallel, or the like, when they function in terms of rotational dynamics, alone or in conjunction with adjoining items, when rotated about the axis of cylindrical symmetry equivalently to items which are parallel.

The base (200) of the mechanism of the yo-yo (100) of the present invention is roughly bowl shaped, and has three spring screw wells (205), three pivot shafts (240), three switch reservoirs (210), and three selector switch detents (210). Each selector switch detent (212) has a detent well (213) in which a detent ball (214) rests on a detent spring (215). When the detent spring (215) is uncompressed, its top extends above the top of the well (213).

The switch chassis (300) of the mechanism of the yo-yo (100) of the present invention has a substantially cylindrical frame (302) from which protrudes three switch levers (310) and three lock plates (320). Each lock plate (320) has a lock aperture (325) with a radially-wide central bay (326), an open notch (327) extending clockwise from the central bay (326) at the outside edge of the central bay (326), and a lock notch (328) extending counterclockwise from the central bay (326) at the inside edge of the central bay (326). Each switch lever (310) has three roughly spherical-section detent catches (312) in the lower surface thereof: a clockwise-most detent catch (312*a*), a central detent catch (312*b*), and counterclockwise-most detent catch (312*c*).

As shown in FIG. 5, the switch chassis (300) nests in the base (200) with the switch levers (310) in the switch reservoirs (210) and the cylindrical body (302) against the inside wall (202) of the base (200). In this nested configuration the switch chassis (300) is rotatable within the base (200) from:

(1) a far-clockwise position where the clockwise edges of the switch levers (310) abut the clockwise edges of the switch reservoirs (210) and the detent ball (214) rests within the counterclockwise-most detent catch (312*c*), to (2) a central position where the switch levers (310) are centered within the switch reservoirs (210) and the detent ball (214) rests within the central detent catch (312*b*), to (3) a far-counterclockwise position where the counterclockwise edges of the switch levers (310) abut the counterclockwise edges of the switch reservoirs (210) and the detent ball (214) rests within the clockwise-most detent catch (312*a*).

The existence of three switch levers (310) provides the advantage that rotation of the switch chassis (300) relative to the base (200) and cover (400) can be implemented by pushing one, two or three of the switch levers (310) according to what is most convenient and/or effective for the player given the orientation and position of the yo-yo (100) relative to the player. Multiple switch levers (310) located on a substantial portion of the circumference of the cover (400) also provide the advantage that when the yo-yo (100) returns along the string (900) to the hand of the player, at least one of the switch levers (310) is generally immediately within reach of one of the fingers of the player.

As shown in FIGS. 9.1 and 9.2, each governor (500) has a pivot sleeve (540) from which extends an outer arm (560) and an inner arm (550). At the base of the inner arm (550) is a grip pad (555), and the inner arm has a spring docking peg (505) extending downwards from its lower surface roughly midway along its length. Extending downwards from the bottom of the outer arm (560) is a setting pin (525). As shown in FIGS. 1B, 2B, 3B, 4B and 5, the governors (500) are rotatably mounted on base (200) with the pivot shafts (240) through the pivot sleeves (540) and the setting pins (525) in the lock apertures (325). Springs (600) extending from the spring screws (605) (which are screwed into the spring screw wells (205) in the bass (200)) to the spring docking pegs (505) on the governors (500) bias the governors (500) in a counterclockwise-rotated position. (In an alternate embodiment of the present invention, a metal ball is attached to or embedded in each outer arm (560) at the end opposite the pivot sleeve (540) to increase the tendency of the governors (500) to rotate outwards, i.e., clockwise, as a result of centrifugal force.)

The cover (400) is preferably transparent and, as shown in FIGS. 8.1 and 8.2, has three attachment shafts (440) and three wings (410), a positioning ring (445), and a axle-mounting nut (470) located at the center of the cover (400). As shown in FIG. 5, in the assembled yo-yo (100) the attachment shafts (440) are inserted into the pivot shafts (240) and the cover (400) is attached to the base (200) by screws (243) which are screwed into the attachment shafts (440) via the screw wells (242). The wings (410) of the cover (400) lie between the switches reservoirs (210) with the edges of the wings (410) roughly coincident with the edges of the switch reservoirs (210). As can be seen in FIGS. 5, 1B, 2B, 3B and 4B, the bottom edge of the positioning ring (445) is adjacent the governors (500) and functions to help maintain their (500) positions and horizontal orientations at the bases of the pivot shafts (240) while not inhibiting rotation of the governors (500) about the pivot shafts (240).

The axle (700) of the yo-yo (100) has an axle shaft (770) which is mounted in a mounting bushing (470) in the top half (100A) of the yo-yo (100), and is screwed into a mounting nut (470') in the bottom half (100B) of the yo-yo (100). The axle bushing (780) is rotatably mounted on the axle shaft (770), and has a groove (782) centered in the gap between the halves (100A) and (100B). Encircling the axle bushing (780) adjacent the grip pads (555) of the governors (500) is an elastomeric grip ring (790). As shown in FIG. 5, the string (900) is double-looped around the axle bushing (780), providing a relatively high-friction contact between the string (900) and axle bushing (780) so the bushing (780) does not readily rotate within the double loop (901) of the string (900). (Alternatively, the string (900) may be triple-looped, quadruple-looped, etc. to provide the relatively high-friction contact between the string (900) and axle bushing (780).)

Figure 1B:
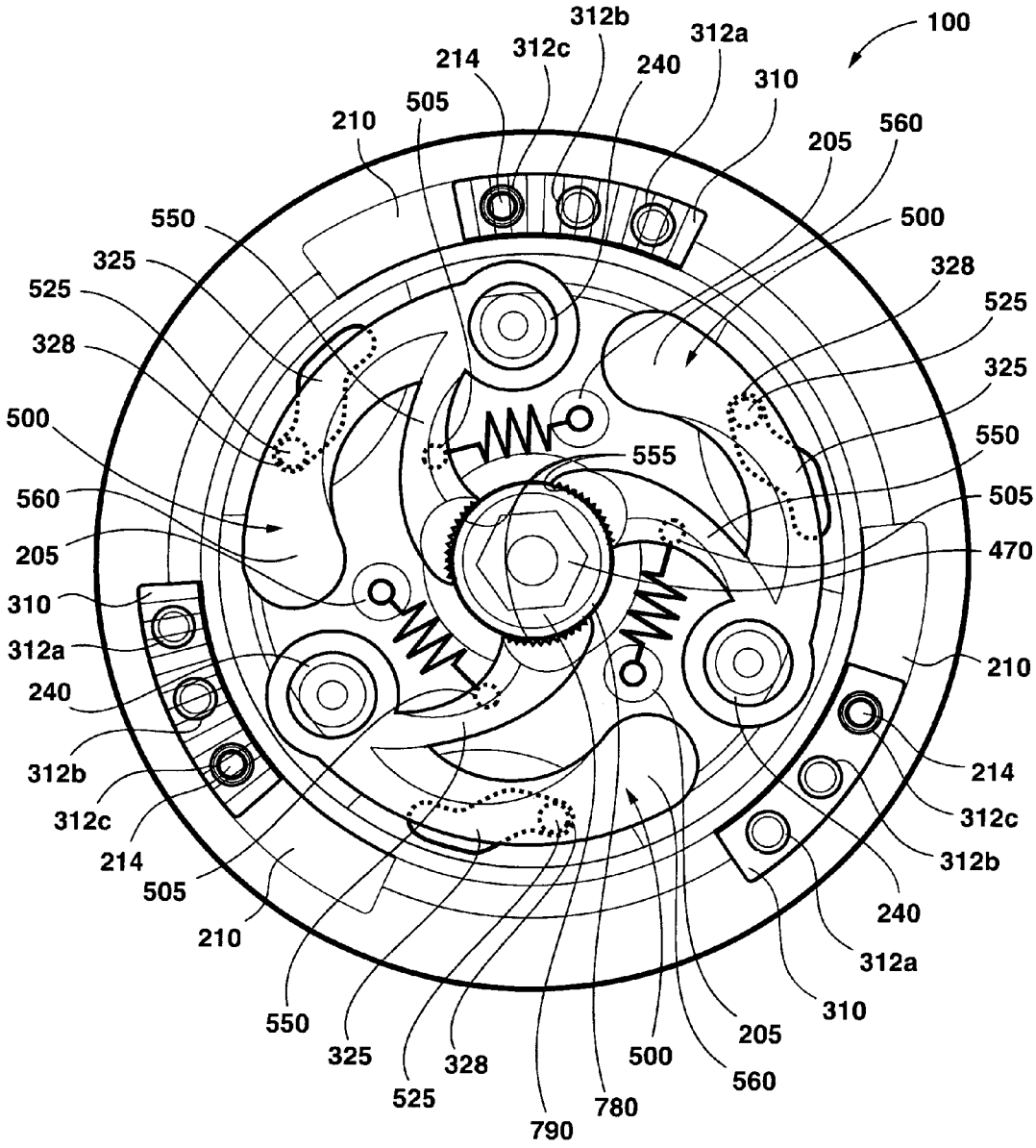
FIG. 1B is an x-ray view of the plan view of FIG. 1A.

As shown in FIGS. 1A and 1B, in the locked setting of the yo-yo (100) of the present invention the switch levers (310) are in the far-clockwise position and the detent ball (214) is located in the counterclockwise-most detent catch (312*c*), stabilizing the setting of the switch levers (310). This position of the switch levers (310) forces the setting pins (525) into the locking notches (328) of the lock aperture (325). This positions the governors (500) in their counterclockwise-most orientations about the pivot shafts (240) so that the grip pads (555) of the inner arms (550) of the governors (500) press against the grip ring (790) of the axle bushing (780), thereby forcing the axle bushing (780) to rotate with the body of the yo-yo (100) so that the yo-yo (100) operates as a traditional yo-yo.

Figure 2B:
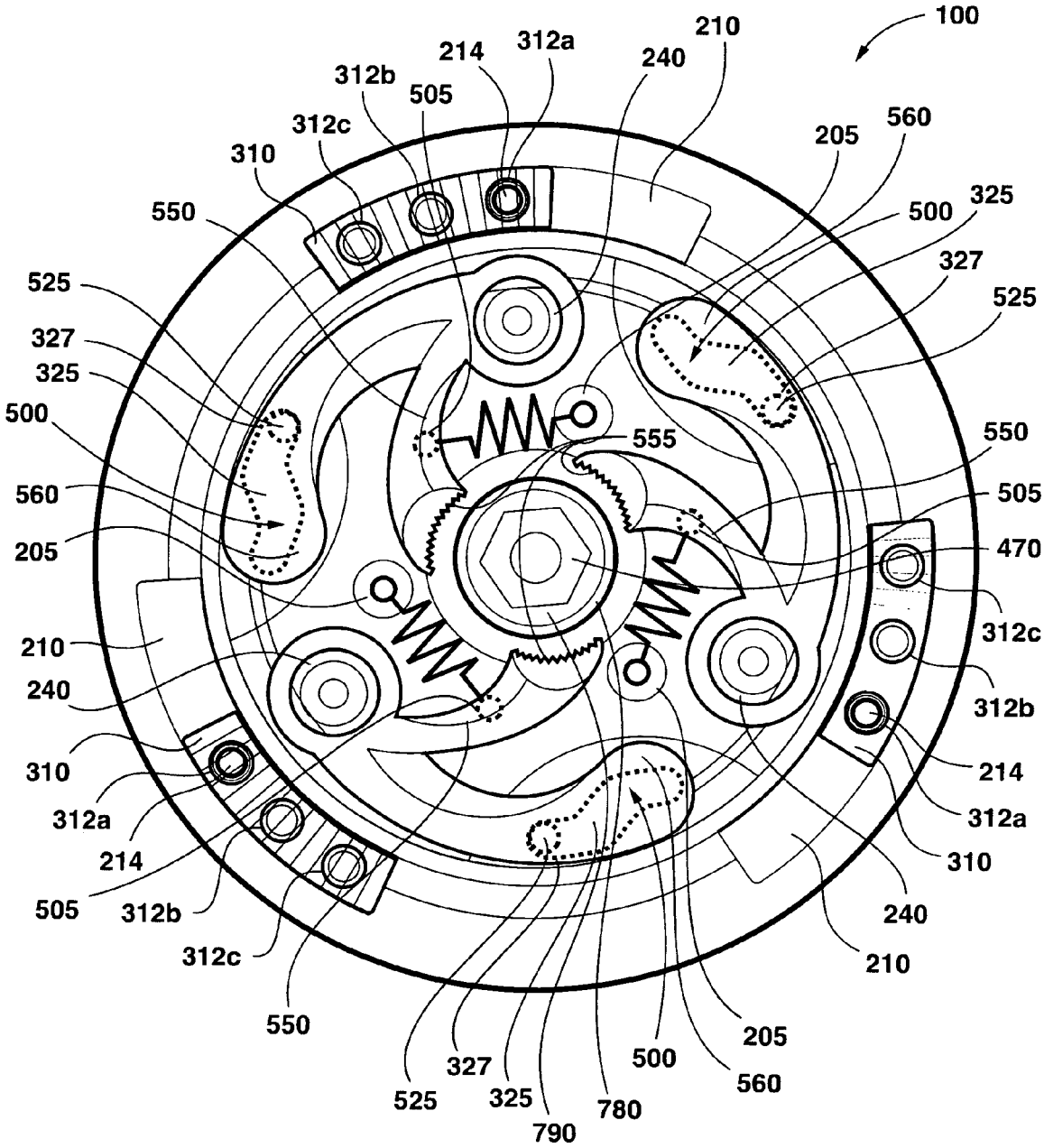
FIG. 2B is an x-ray view of the plan view of FIG. 2A.

As shown in FIGS. 2A and 2B, in the open setting of the yo-yo (100) of the present invention the switch levers (310) are in the far-counterclockwise position and the detent ball (214) is located in the clockwise-most detent catch (312*a*), stabilizing the setting of the switch levers (310). This position of the switch levers (310) forces the setting pins (525) into the opening notches (327) of the lock aperture (325). This positions the governors (500) in their clockwise-most orientations about the pivot shafts (240) so that the grip pads (555) of the inner arms (550) of the governors (500) do not contact the grip ring (790) of the axle bushing (780), so the axle bushing (780) is freely rotatable relative to the body of the yo-yo (100) so that the yo-yo (100) operates as a free-spin yo-yo.

Figure 3B:
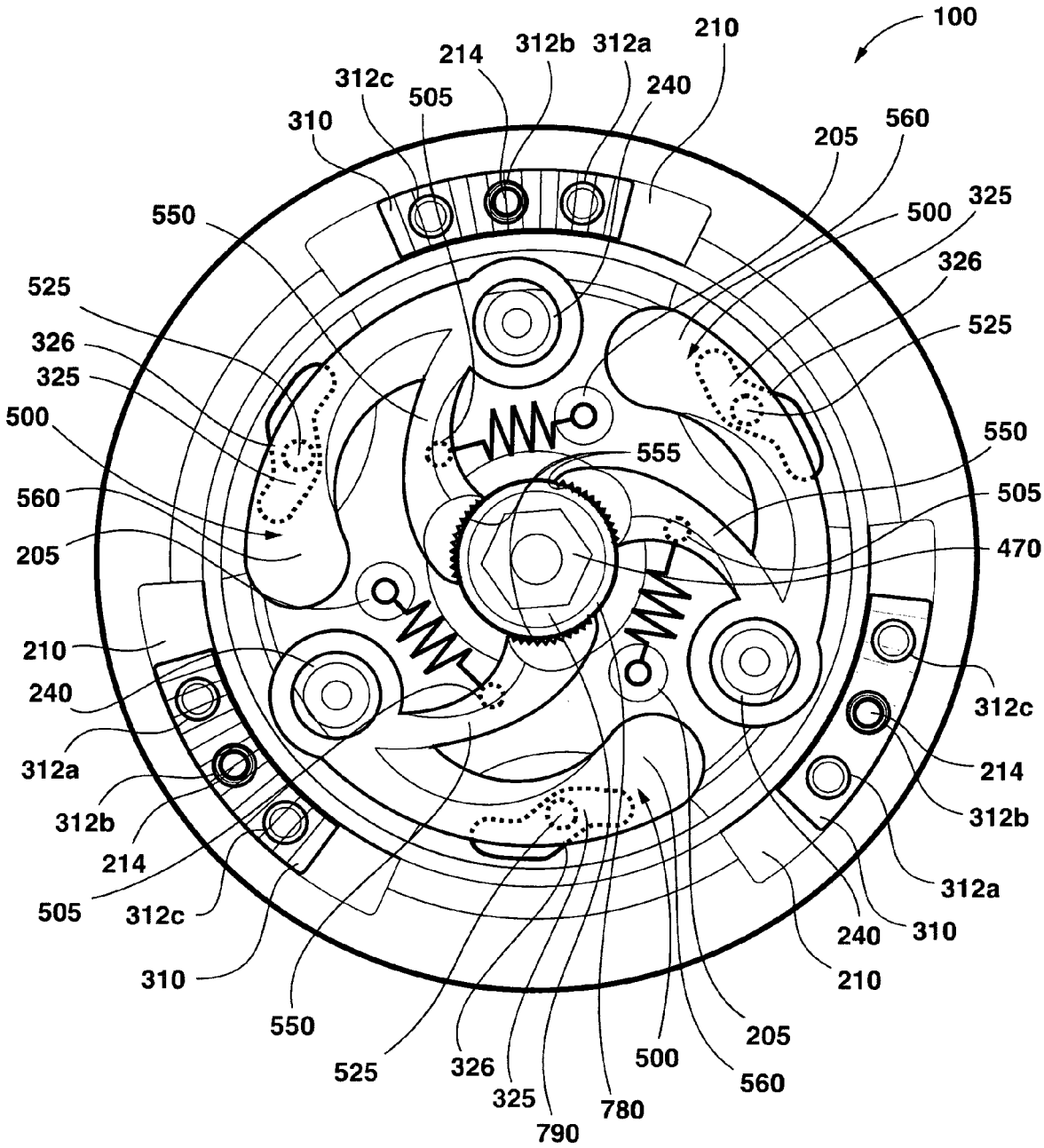
FIG. 3B is an x-ray view of the plan view of FIG. 3A.
Figure 4A:
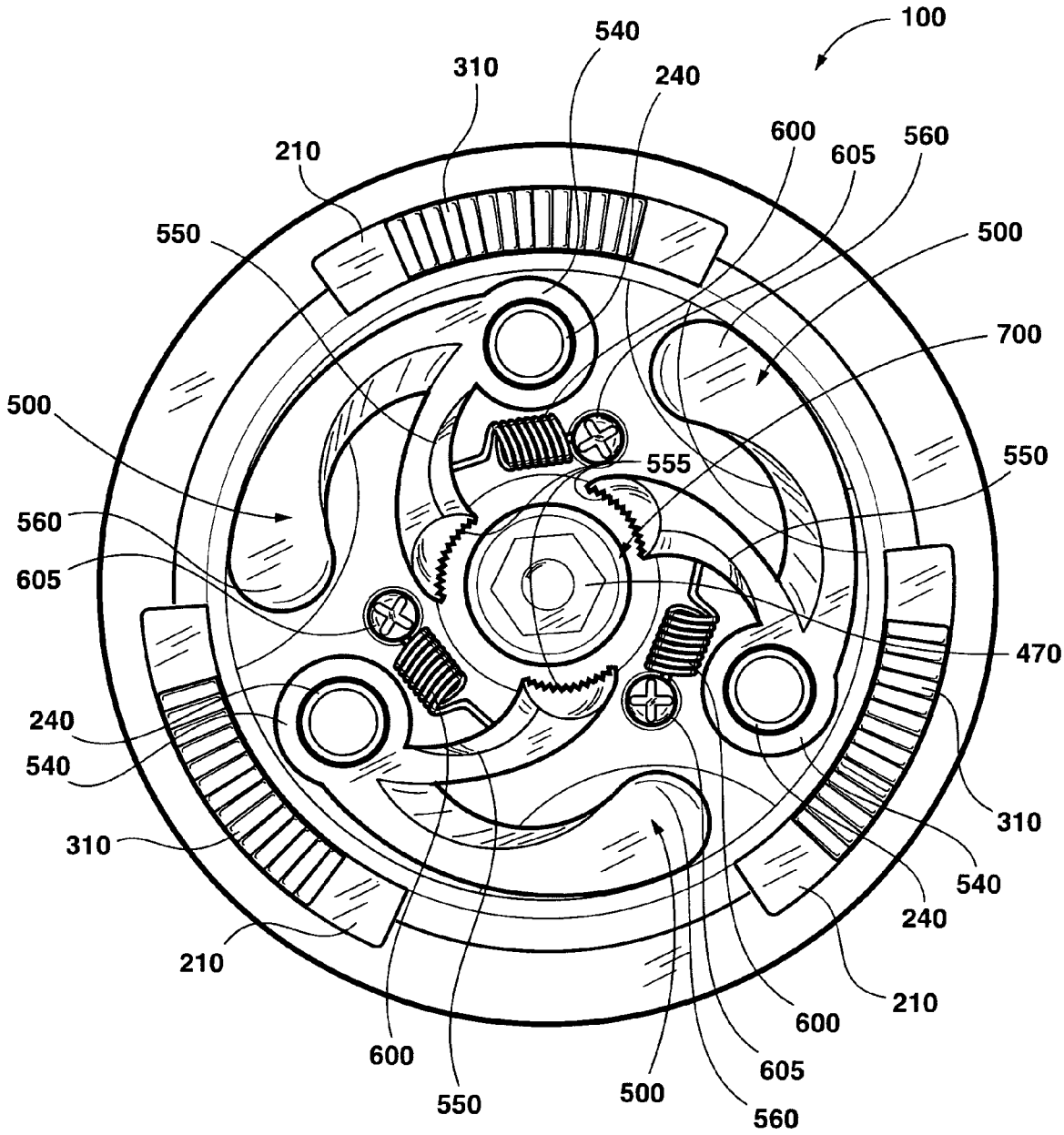
FIG. 4A is a plan view of the mechanism of the yo-yo of the present invention in the setting providing a centrifugal-clutch yo-yo with centrifugal force acting to position the governors outwards.
Figure 4B:
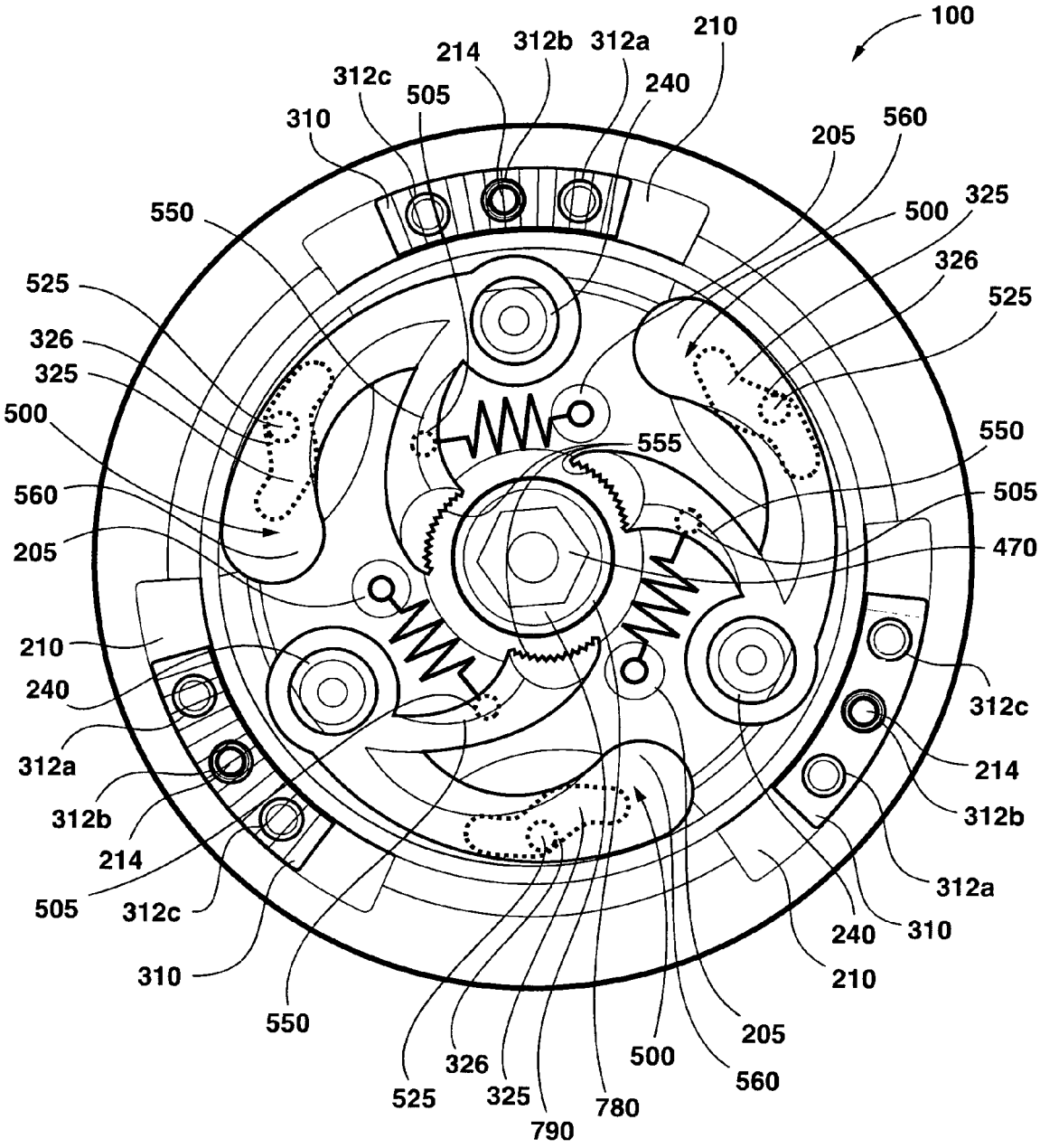
FIG. 4B is an x-ray view of the plan view of FIG. 4A.
Figure 5:
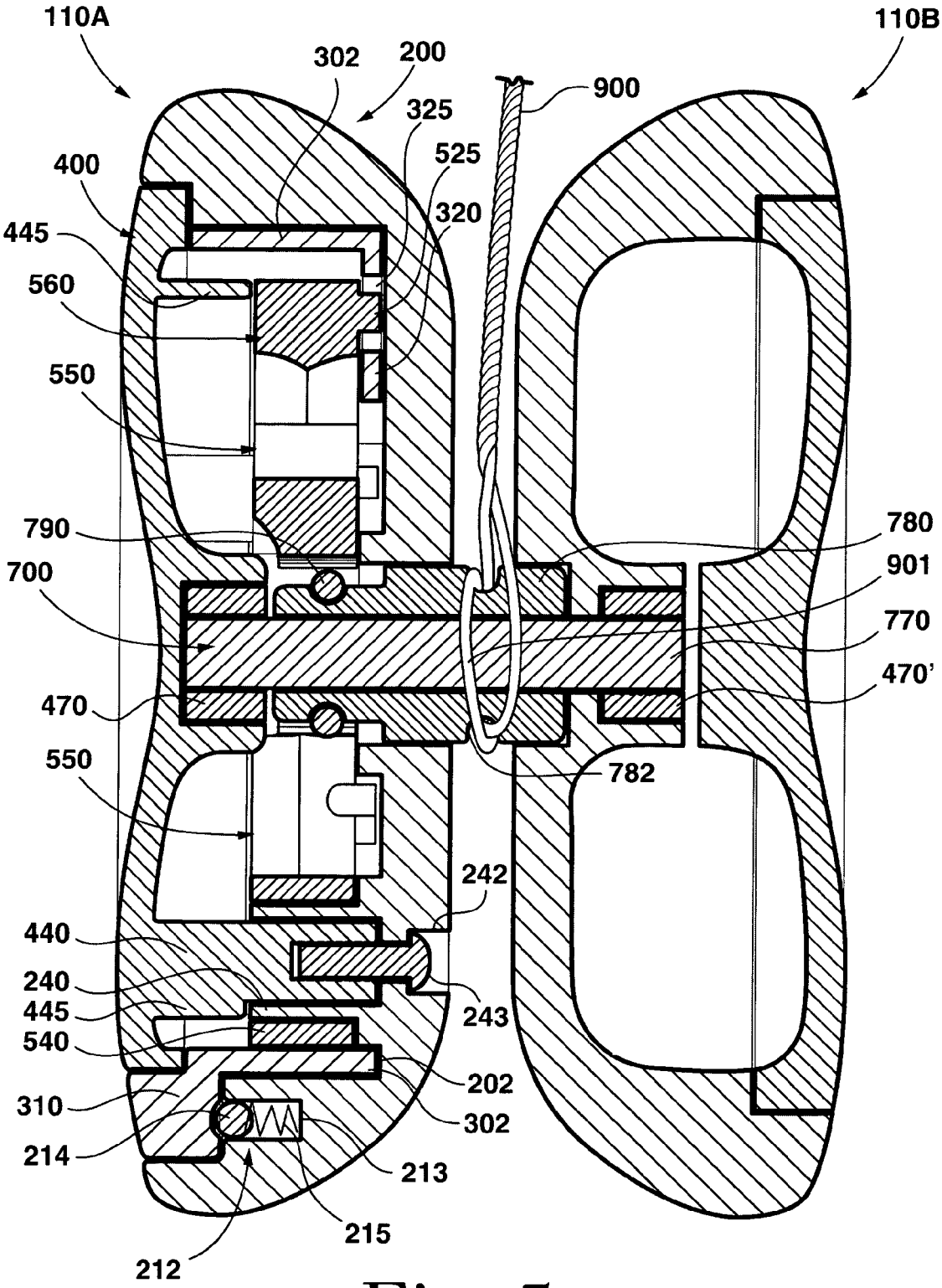
FIG. 5 is a cross-sectional side view of the mechanism of the yo-yo of the present invention.

As shown in FIGS. 3A, 3B, 4A and 4B, in the centrifugal-clutch setting of the yo-yo (100) of the present invention the switch levers (310) are in the central position and the detent ball (214) is located in the central detent catch (312*b*), stabilizing the setting of the switch levers (310). This position of the switch levers (310) locates the setting pins (525) in the central bays (326) of the lock aperture (325). Due to the wideness of the central bays (326) relative to the diameters of the setting pins (525), the governors (500) can rotate from a clockwise-most orientation about the pivot shafts (240)

where the grip pads (555) of the inner arms (550) of the governors (500) do not contact the grip ring (790) of the axle bushing (780), as shown in FIGS. 4A and 4B, to a counter-clockwise-most orientation about the pivot shafts (240) where the grip pads (555) of the inner arms (550) of the governors (500) press against the grip ring (790) of the axle bushing (780), as shown in FIGS. 3A and 3B. When the body of the yo-yo (100) spins sufficiently fast, the centrifugal force on the governors (500) overcomes the biases produced by the springs (600), the governors (500) move to their clockwise-most positions and grip pads (555) move away from contact with the grip rings (790) of the axle bushing (780), and the yo-yo (100) operates as a free-spin yo-yo. When the body of the yo-yo (100) spins sufficiently slowly, the biases produced by the springs (600) overcome the centrifugal force on the governors (500), the governors (500) move to their counter-clockwise-most positions and grip pads (555) press against the grip rings (790) on the axle bushing (780), and the yo-yo (100) operates as a traditional yo-yo. Also, when there is a sharp translational acceleration perpendicular to the spin axis of the yo-yo (100), for instance as a result of a tug on the yo-yo string, the governors (500) may be forced inwards so that the grip pads (555) contact the grip rings (790) and the yo-yo (100) operates as a traditional yo-yo. Thus, with the switch levers (310) in the central position the yo-yo (100) of the present invention operates as a centrifugal-clutch yo-yo.

Thus, it will be seen that the improvements presented herein are consistent with objects and advantages of a multi-function yo-yo as described above. While the above description contains many specificities, these should not be construed as limitations in the scope of the invention, but rather as exemplifications of a preferred embodiment thereof. A wide range of variations in design and construction are within the scope of the present invention. For instance, although the two sides (100A, 100B) of the yo-yo (100) are referred to as "disks" in the present specification or claims, and depicted as having substantially equal size, substantially cylindrical symmetry, being relatively flat (i.e., having a thickness-to-diameter ratio considerably less than unity), being roughly mirror images of each other, and of roughly equal exterior dimensions, the "disks" (100A, 100B) of the yo-yo (100) need not be disk shaped, or be of equal size, or have substantially cylindrical symmetry, or be relatively flat, or be roughly mirror images of each other, or be of roughly equal exterior dimensions. However, the sides (100A, 100B) should be weighted and balanced so that their rotational dynamics are substantially equivalent to that of two disks of equal size and weight, so that the sides (100A, 100B) will spin about the axle when "sleeping" at the end of the string without excessive wobbling. Some other variations within the scope of the invention include: the string may be a single-filament or multi-filament, braided or wound string, thread, thin rope, or the like; and the axle need not be strictly cylindrical; the governors need not be bifurcated arms; the spring biasing may be accomplished with elastic bands or other spring biasing means; another system of detents for the switch may be used; the mechanism connecting the switch levers to the control of the governors may be different than that described; the mechanism may have a single governor, two-fold rotational symmetry, n-fold rotational symmetry where n is greater than 3, or no rotational symmetry; the function switching mechanism may have a construction otherwise different from that described in the detailed description or have variations other than those listed above; and so on.

Accordingly, it is intended that the scope of the invention is determined not by the embodiments illustrated or the physical analyses motivating the illustrated embodiments but, rather, by the appended claims and their legal equivalents.

What is claimed is:

1. A multi-function yo-yo comprising:

an axle having a first axis of cylindrical symmetry and an axle mass, said first axis defining an axial direction parallel to said first axis, and defining, for a point off said first axis, a radial direction along a direction perpendicular to said first axis and passing through said point, and defining, for said point off said first axis, an azimuthal direction, perpendicular to said first axis and said radial direction and passing through said point;

a first fly disk centrally mounted at a first end of said axle, said first fly disk having a first mass substantially larger than said axle mass, and having a second axis of cylindrical symmetry coincident with said first axis of cylindrical symmetry;

a second fly disk centrally mounted at a second end of said axle, said second fly disk having a second mass substantially larger than said axle mass, and having a third axis of cylindrical symmetry coincident with said first and second axes of cylindrical symmetry;

an axle sleeve surrounding a central portion of said axle and being rotatable with respect to said axle;

a string tethering said axle sleeve;

a first rotational-speed governor movably mounted in said first fly disk and having a first sleeve grip, said first governor having spring biasing towards a radially inwards position where said first sleeve grip contacts said axle sleeve, and said first governor being thrown by centrifugal force to a radially outwards position when said first fly disk rotates about said axle axis with sufficient speed, and when said first governor is in said radially outwards position said first sleeve grip is drawn away from contact with said axle sleeve; and a function switch on an exterior surface of said first fly disk, when said function switch is in a first switch position said first governor is locked in said radially inwards position so that said first sleeve grip contacts said axle sleeve and the yo-yo acts as a fixed axle yo-yo, when said function switch is in a second switch position said first governor is locked in said radially outwards position so that said first sleeve grip does not contact said axle sleeve and the yo-yo acts as a free axle yo-yo, and when said function switch is in a third switch position said first governor is free to move between said radially inwards position and said radially outwards position in response to a combination of said spring biasing and said centrifugal force and the yo-yo acts as a centrifugal-clutch yo-yo.

2. The multi-function yo-yo of claim 1 wherein said governor is rotatably mounted on a pivot shaft in said first fly disk having a fourth axis of cylindrical symmetry essentially parallel to said first axis, said governor having an outer arm, and an inner arm radially inwards from said outer arm, with said inner arm including said sleeve grip.

3. The multi-function yo-yo of claim 1 wherein said governor has a function control pin protruding therefrom, and said switch is mounted on a switch plate having a lock aperture, said lock aperture having a radially-wide central bay, a radially-narrow outer notch extending in a first azimuthal direction from said central bay at an outside edge of said central bay, and a radially-narrow inner notch extending in a second azimuthal direction from said central bay at an inside edge of said central bay, said first azimuthal direction being opposite said second azimuthal direction, positioning of said switch in said first position forcing said function control pin into said inner notch, positioning of said switch in said second position forcing said function control pin into said outer notch, and positioning of said switch in said third position forcing said function control pin into said central bay.

4. The multi-function yo-yo of claim 1 further including a second rotational-speed governor movably mounted in said first fly disk and having a second sleeve grip, said second governor having spring biasing towards a radially inwards position where said second sleeve grip contacts said axle sleeve, and said first governor being thrown by centrifugal force to a radially outwards position when said first fly disk rotates about said axle axis with sufficient speed, and when said first governor is in said radially outwards position said second sleeve grip is drawn away from contact with said axle sleeve, and wherein when said function switch is in said first switch position said second governor is locked in said radially inwards position so that said second sleeve grip contacts said axle sleeve, when said function switch is in said second switch position said second governor is locked in said radially outwards position, and when said function switch is in said third switch position said first governor is free to move between said radially inwards position and said radially outwards position in response to a combination of said spring biasing and said centrifugal force.

5. The multi-function yo-yo of claim 4 further including a third rotational-speed governor movably mounted in said first fly disk and having a third sleeve grip, said third governor having spring biasing towards a radially inwards position where said third sleeve grip contacts said axle sleeve, and said third governor being thrown by centrifugal force to a radially outwards position when said first fly disk rotates about said axle axis with sufficient speed, and when said third governor is in said radially outwards position said third sleeve grip is drawn away from contact with said axle sleeve, and wherein when said function switch is in said first switch position said third governor is locked in said radially inwards position so that said third sleeve grip contacts said axle sleeve, when said function switch is in said second switch position said third governor is locked in said radially outwards position, and when said function switch is in said third switch position said third governor is free to move between said radially inwards position and said radially outwards position in response to a combination of said spring biasing and said centrifugal force.

6. The multi-function yo-yo of claim 1 wherein said function switch has three switch levers for control of said function switch, said three switch levers being roughly equally spaced along the outside edge of said first fly disk.

7. The multi-function yo-yo of claim 5 wherein said function switch has three switch levers for control of said function switch, said three switch levers being roughly equally spaced along the outside edge of said first fly disk.

8. The multi-function yo-yo of claim 1 wherein said function switch has multiple switch levers for control of said function switch, said multiple switch levers being roughly equally spaced along the outside edge of said first fly disk.

9. The multi-function yo-yo of claim 1 wherein said first and second fly disks are of substantially equal exterior dimensions, substantially cylindrically symmetric, mirror images of each other, and have a thickness-to-diameter ratio considerably less than unity.

10. The multi-function yo-yo of claim 1 wherein said string has a double loop at one end, said double loop encircling said axle sleeve.

* * * * *